US007372211B2

(12) United States Patent
Honbo

(10) Patent No.: US 7,372,211 B2
(45) Date of Patent: May 13, 2008

(54) COLD CATHODE TUBE LIGHTING DEVICE AND DRIVING METHOD AND INTEGRATED CIRCUIT TO BE USED IN SAME

(75) Inventor: Nobuaki Honbo, Kawasaki (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 199 days.

(21) Appl. No.: 11/362,839

(22) Filed: Feb. 28, 2006

(65) Prior Publication Data

US 2006/0192500 A1 Aug. 31, 2006

(30) Foreign Application Priority Data

Feb. 28, 2005 (JP) ..... 2005-054698

(51) Int. Cl.
*H05B 37/02* (2006.01)
*H05B 41/16* (2006.01)

(52) U.S. Cl. ..... 315/220; 315/246; 315/277; 315/308; 315/309

(58) Field of Classification Search ..... 315/209 R, 315/219, 220, 224, 225, 226, 246, 247, 277, 315/283, 291, 307, 308, 309, DIG. 2, DIG. 5, 315/DIG. 7
See application file for complete search history.

(56) References Cited

U.S. PATENT DOCUMENTS 7,166,969 B2 * 1/2007 Kohno ..... 315/209 PZ
2005/0146291 A1 * 7/2005 Lee ..... 315/308

FOREIGN PATENT DOCUMENTS

| | | |
|---|---|---|
| JP | 11-204277 | 7/1999 |
| JP | 2002-017090 | 1/2002 |
| JP | 2003-168584 | 6/2003 |
| JP | 2003-324962 | 11/2003 |

* cited by examiner

*Primary Examiner*—Thuy Vinh Tran
(74) *Attorney, Agent, or Firm*—Young & Thompson

(57) ABSTRACT

A cold cathode tube lighting device is provided which is capable of obtaining stable luminance when a cold cathode tube is driven by applying voltages to input terminals on both ends of the cold cathode tube. A first current flowing through each of transformer secondary sides of transformers is detected by a tube current detecting circuit from a low-voltage side of each of the transformer secondary sides and a second current flowing through each of resonance capacitors is detected by the tube current detecting circuit and a difference between the first current and the second current is calculated for every separately-excited inverter and, based on the difference, a tube current of the cold cathode tube is obtained and frequencies of driving pulse voltages are changed by a voltage controlling oscillator for setting so that the tube current maintains a predetermined value.

21 Claims, 14 Drawing Sheets

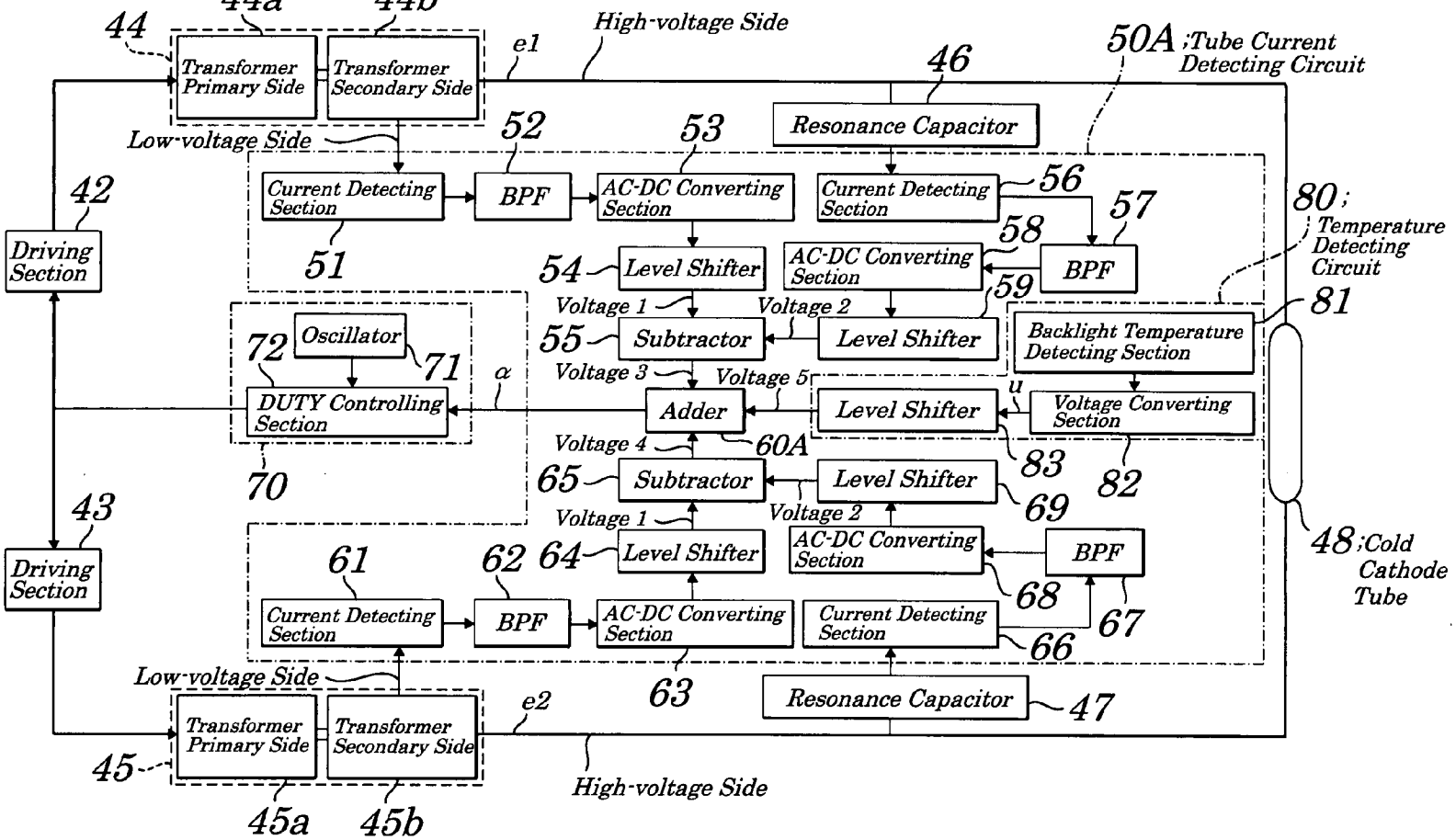
FIG.6
50A ;Tube Current Detecting Circuit
80 ; Temperature Detecting Circuit
81
48 ;Cold Cathode Tube
Backlight Temperature Detecting Section
Voltage Converting Section
82
u
83
57
BPF
56
58
59
67
BPF
68
66
47
46
Resonance Capacitor
Current Detecting Section
AC-DC Converting Section
Level Shifter
Level Shifter
Level Shifter
AC-DC Converting Section
Current Detecting Section
Resonance Capacitor
Voltage 2
Voltage 5
60A
Voltage 2
High-voltage Side
53
AC-DC Converting Section
Level Shifter
Subtractor
Adder
Subtractor
Level Shifter
AC-DC Converting Section
63
High-voltage Side
Voltage 1
Voltage 3
Voltage 4
Voltage 1
54
55
65
64
e1
52
BPF
α
62
BPF
e2
44b
Transformer Secondary Side
Current Detecting Section
51
Oscillator
71
DUTY Controlling Section
72
70
61
Current Detecting Section
Transformer Secondary Side
45b
44a
Transformer Primary Side
Low-voltage Side
Low-voltage Side
Transformer Primary Side
45a
44
45
42
Driving Section
43
Driving Section

COLD CATHODE TUBE LIGHTING DEVICE AND DRIVING METHOD AND INTEGRATED CIRCUIT TO BE USED IN SAME

BACKGROUND OF THE INVENTION

1. Field of the Invention

The present invention relates to a cold cathode tube lighting device and a driving method and an integrated circuit to be employed in the cold cathode tube lighting device and more particularly to the cold cathode tube lighting device being suitably used when the cold cathode tube being used as a backlight of a liquid crystal display device is driven by applying voltages to input terminals on both ends of the cold cathode tube using separately-excited inverters and to the driving method and the integrated circuit to be used in the cold cathode tube lighting device.

The present application claims priority of Japanese Patent Application No. 2005-054698 filed on Feb. 28, 2005, which is hereby incorporated by reference.

2. Description of the Related Art

In recent years, a liquid crystal display device is used not only for monitors of personal computers, but also for various display devices such as a liquid crystal display television set. In the case of liquid crystal display television sets or a like in particular, upsizing of a liquid crystal panel progresses. As a result, backlights used in liquid crystal display devices are becoming larger in size and cold cathode tubes used in the backlights are also becoming longer. When the cold cathode tube as above is lit, in the case of shorter cold cathode tubes, its one input terminal is used as a low-voltage side and another input terminal is used as a high-voltage side and a driving pulse voltage is input to the high-voltage side. However, in the case of the longer cold cathode tubes or the cold cathode tubes having a small diameter, since impedance of the cold cathode tubes is made higher, when a driving pulse voltage is input from one input terminal (high-voltage side) of the cold cathode tubes, a display area in a region near the input terminal on the high-voltage side becomes brighter and the display area in a region near to the input terminal on the low-voltage side becomes darker, causing a luminance gradient (uneven lighting) to occur. To prevent the occurrence of the luminance gradient (uneven lighting), a both-side high-voltage driving method is employed in which the cold cathode tubes are made to light by applying driving pulse voltages which are 180° out of phase with each other to the input terminals on both ends of the cold cathode tubes. Moreover, in order to improve the efficiency of the backlight, even in the case where the cold cathode tubes are of "U"-shaped or "C"-shaped, the both-side high-voltage driving method is also used in some cases.

A conventional cold cathode tube lighting device of this type, as shown in FIG. 11, includes an oscillator 1, driving sections 2 and 3, transformers 4 and 5, and resonance capacitors 6 and 7. To output sides of the transformers 4 and 5 is connected a cold cathode tube 8. In the cold cathode tube lighting device, an oscillation frequency of the oscillator 1 is set at a frequency close to a resonant frequency of a resonant circuit made up of an inductance on each of transformer secondary sides 4*b* and 5*b* of the transformers 4 and 5 and by each of the resonance capacitors 6 and 7. High-frequency voltages having a frequency set by the oscillator 1 are generated and input to each of the transformer primary sides 4*a* and 5*a* of the transformers 4 and 5 and driving pulse voltages "e1" and "e2", which are 180° out of phase with each other, output from the transformer secondary sides 4*b* and 5*b* of the transformers 4 and 5, respectively. Each of the driving pulse voltages "e1" and "e2" is applied to each of input terminals on both ends of the cold cathode tube 8 which lights the cold cathode tube 8.

Other conventional technologies of this type, besides the cold cathode tube lighting device as described above, are disclosed in following references. That is, a conventional piezoelectric transformer driving device disclosed in Patent Reference 1 (Japanese Patent Application Laid-open No. 2002-017090, Abstract, FIG. 1), as shown in FIG. 12, includes a power source 11, a driving circuit 12, a variable oscillating circuit 13, an oscillation controlling circuit 14, a piezoelectric transformer 15, a voltage detecting circuit 16, a current detecting circuit 17, a phase difference detecting circuit 18, and an active current detecting circuit 19. Between the piezoelectric transformer 15 and the current detecting circuit 17 is connected a cold cathode tube 20. In the vicinity of the cold cathode tube 20 is provided a reflecting plate 21 being grounded and floating capacitance Cx is formed between the cold cathode tube 20 and the reflecting plate 21. In the conventional piezoelectric transformer driving device, a tube current (a current output from the piezoelectric transformer 15) flowing through the cold cathode tube 20 is detected by the current detecting circuit 17 and a phase difference between output voltage and output current from the piezoelectric transformer 15 is detected by the phase difference detecting circuit 18. Based on the phase difference, an active current flowing through the cold cathode tube 20 is detected by the active current detecting circuit 19 and the piezoelectric transformer 15 is so controlled as to be driven via the oscillation controlling circuit 14, variable oscillating circuit 13, and driving circuit 12 so that the active current becomes a predetermined value.

A conventional piezoelectric transformer driving circuit disclosed in Patent Reference 2 (Japanese Patent Application Laid-open No. 2003-324962, Abstract, FIG. 1), as shown in FIG. 13, includes a piezoelectric transformer driving section 31, piezoelectric transformers 32 and 33, and a cold cathode tube 34 is connected to output sides of the piezoelectric transformer 32 and 33. The piezoelectric transformer driving circuit also has a current transformer 35, a resistor R, capacitors C1 and C2, a differential amplifying section 36, and a rectifying section 37. In the piezoelectric transformer driving circuit, a tube current flowing through a load (cold cathode tube 34) is detected by the current transformer 35 and an output from a resonant circuit formed by a secondary side component of the current transformer 35 and of each of capacitors C1 and C2 is fed back to the piezoelectric transformer driving section 31 through the differential amplifying section 36 and the rectifying section 37 so that an output from the piezoelectric transformer driving section 31 is controlled.

In an inverter circuit of a discharge lamp lighting device disclosed in Patent Reference 3 (Japanese Patent Application Laid-open No. 2003-168584, Abstract, FIG. 1), an output frequency is controlled according to a dimming ratio indicated by a dimming signal. A change in the output frequency causes a voltage applied to a discharge lamp to be changed. A filament voltage detecting circuit detects a voltage across a filament of the discharge lamp. A judging circuit, when judging that the discharge lamp operates abnormally at time of a rise in the output voltage in the filament voltage detecting circuit, stops operations of the inverter circuit. This enables an exact detection of such an abnormality as may occur at an end of a life of the discharge lamp.

In a discharge lamp lighting device disclosed in Patent Reference 4 (Japanese Patent Application Laid-open No. Hei 11-204277, Abstract, FIG. 1), a change in impedance of each filament of a plurality of discharge lamps is detected. When an abnormal change is detected in impedance of at least one filament at time of pre-heating, sufficient preheating power is supplied to remaining filaments and, after being preheated, a stable operation of the corresponding discharge lamp is started.

However, the conventional cold cathode tube lighting devices described above have the following problems. That is, luminance in a cold cathode tube is determined by a tube current flowing through the cold cathode tube. In the one-side high-voltage driving method in which a driving pulse voltage is input from an input terminal on one side of the cold cathode tube, in many cases, a current detecting circuit made up of a resistor or a like is provided on a low-voltage side where no driving pulse voltage is input and control is exerted to keep luminance in the cold cathode tube constant based on a current detected by the current detecting circuit. However, in the both-side high-voltage driving method using separately-excited inverters as shown in FIG. 11, driving pulse voltages "e1" and "e2" are applied to both input terminals of the cold cathode tube 8 and a current detecting circuit such as a resistor cannot be inserted, which presents a problem that detection of a tube current flowing through the cold cathode tube 8 is made difficult, causing keeping the luminance of the cold cathode tube 8 constant to be impossible. Moreover, in the case where the cold cathode tube 8 is driven by using the separately-excited inverters, as shown in FIG. 14, a current flowing through transformer secondary sides 4*b* and 5*b* of the transformers 4 and 5 contains a tube current flowing through the cold cathode tube 8 and a current flowing through the resonance capacitors 6 and 7, which presents a problem that, even if control is exerted so that current values on the transformer secondary sides 4*b* and 5*b* of the transformers 4 and 5 become constant, a ratio of the current flowing through the resonance capacitors 6 and 7 to the tube current flowing through the cold cathode tube 8 changes due to secular changes in characteristics of the cold cathode tube 8, also resulting in the luminance of the cold cathode tube 8 to deteriorate.

Moreover, the conventional piezoelectric transformer driving device disclosed in the Patent Reference 1 has a problem that, since a voltage output from its piezoelectric transformer 15 is high, as a component to which the high voltage is applied, the use of a high voltage tolerant component is required, which causes a rise in costs of the driving device. Furthermore, another problem is that, since a tube current is detected only on one side of the cold cathode tube 20, due to terminal-to-terminal variations of the piezoelectric transformer 15 and/or the cold cathode tube 20, exact detection of the tube current is impossible.

Also, the conventional piezoelectric driving device disclosed in the Patent Reference 2 has also a similar problem that, since voltages output from its piezoelectric transformers 32 and 33 are high, as a component to which the high voltages are applied, the use of a high voltage tolerant component is required, which causes a rise in costs of the driving device. Furthermore, another problem is that, since a tube current is detected only on one side of the cold cathode tube 34, due to terminal-to-terminal variations of the piezoelectric transformers 32 and 33 and/or the cold cathode tube 34, exact detection of the tube current is impossible.

In the discharge lamp lighting device disclosed in Patent Reference 3, though it is possible to exactly detect such an abnormality as may occur at an end of a life of the discharge lamp, it is impossible to keep its luminance constant.

In the discharge lamp lighting device disclosed in Patent Reference 4, though a stable operation of the discharge lamp other than the discharge lamps in which an abnormal change in impedance is detected is started, it is impossible to keep its luminance constant.

SUMMARY OF THE INVENTION

In view of the above, it is an object of the present invention to provide a cold cathode tube lighting device which is capable of keeping a tube current flowing through a cold cathode tube constant to avoid variations in luminance in a case where the cold cathode tube is operated according to a both-side high-voltage driving method using separately-excited inverters.

It is another object of the present invention to provide a driving method and an integrated circuit to be employed in the cold cathode tube lighting device.

According to a first aspect of the present invention, there is provided a cold cathode tube lighting device including:

a first separately-excited inverter which includes a first resonant circuit including a first transformer and a first resonance capacitor, connected to a first input terminal of a cold cathode tube;

a second separately-excited inverter which includes a second resonant circuit including a second transformer and a second resonance capacitor, connected to a second input terminal of the cold cathode tube;

wherein a first driving pulse voltage is generated by the first resonant circuit in the first separately-excited inverter, and a second driving pulse voltage is generated by the second resonant circuit in the second separately-excited inverter, and wherein the first and the second driving pulse voltages are 180° out of phase with each other, and are applied alternately to the first input terminal and the second input terminal of the cold cathode tube from a transformer secondary side of the first transformer and a transformer secondary side of the second transformer to light the cold cathode tube, the device further including:

a tube current controlling unit to detect a tube current flowing through the cold cathode tube, based on a first current flowing through the transformer secondary side of each of the first and the second transformers, and on a second current flowing through each of the first and the second resonance capacitors, and to exert control so that the tube current maintains a predetermined value, based on the detected result.

In the foregoing first aspect, a preferable mode is one wherein the tube current controlling unit is so configured as to detect respectively the first current of a low-voltage side at the transformer secondary side of each of the first and the second transformers and the second current flowing through each of the first and the second resonance capacitors, to calculate a difference between the first current and the second current detected respectively in each of the first and second separately-excited inverters, to obtain the tube current based on the difference, and to change a frequency of each of the first and the second driving voltages for setting so that the tube current maintains the predetermined value, based on the obtained result.

Also, a preferable mode is one wherein the tube current controlling unit is so configured as to detect respectively the first current of a low-voltage side at the transformer secondary side of each of the first and the second transformers and the second current flowing through each of the first and the second resonance capacitors, to calculate a difference between the first current and the second current detected respectively in each of the first and second separately-excited inverters, to obtain the tube current based on the difference, and to change a duty ratio of each of the first and the second driving voltages for setting so that the tube current maintains the predetermined value, based on the obtained result.

Also, a preferable mode is one that wherein further includes a temperature detecting unit to detect a temperature of the cold cathode tube, wherein the tube current controlling unit detects the tube current flowing through the cold cathode tube based on the detected first current flowing through the transformer secondary side of each of the first and the second transformers, on the detected second current flowing through each of the first and the second resonance capacitors, and on the detected temperature of the cold cathode tube detected by the temperature detecting unit, and exerts control so that the tube current maintains a predetermined value, based on the detected result.

Also, a preferable mode is one wherein the tube current controlling unit is so configured as to detect respectively the first current of a low-voltage side at the transformer secondary side of each of the first and the second transformers and the second current flowing through each of the first and the second resonance capacitors, to calculate a difference between the first current and the second current detected respectively in each of the first and second separately-excited inverters, to obtain the tube current based on the difference and on a temperature of the cold cathode tube detected by the temperature detecting unit, and to change a frequency of each of the first and the second driving voltages for setting so that the tube current maintains the predetermined value, based on the obtained result.

Also, a preferable mode is one wherein the tube current controlling unit is so configured as to detect respectively the first current of a low-voltage side at the transformer secondary side of each of the first and the second transformers and the second current flowing through each of the first and the second resonance capacitors, to calculate a difference between the first current and the second current detected respectively in each of the first and second separately-excited inverters, to obtain the tube current based on the difference and on a temperature of the cold cathode tube detected by the temperature detecting unit, and to change a duty ratio of each of the first and the second driving voltages for setting so that the tube current maintains the predetermined value, based on the obtained result.

Also, a preferable mode is one that wherein further includes an output voltage monitoring unit to detect an output voltage of the transformer secondary side of each of the first and the second transformers, and to stop operations of the first and the second separately-excited inverters when an abnormality has occurred in at least one output voltage.

According to a second aspect of the present invention, there is provided a driving method to be used in a cold cathode tube lighting device including: a first separately-excited inverter which includes a first resonant circuit including a first transformer and a first resonance capacitor, connected to a first input terminal of a cold cathode tube; a second separately-excited inverter which includes a second resonant circuit including a second transformer and a second resonance capacitor, connected to a second input terminal of the cold cathode tube; wherein a first driving pulse voltage is generated by the first resonant circuit in the first separately-excited inverter, and a second driving pulse voltage is generated by the second resonant circuit in the second separately-excited inverter, and wherein the first and the second driving pulse voltages are 180° out of phase with each other, and are applied alternately to the first input terminal and the second input terminal of the cold cathode tube from a transformer secondary side of the first transformer and a transformer secondary side of the second transformer to light the cold cathode tube, the method including:

detecting a tube current flowing through the cold cathode tube, based on a first current flowing through the transformer secondary side of each of the first and the second transformers, and on a second current flowing through each of the first and the second resonance capacitors, and exerting control so that the tube current maintains a predetermined value, based on the detected result.

In the foregoing second aspect, a preferable mode is one wherein the detecting of the tube current includes detecting respectively the first current of a low-voltage side at the transformer secondary side of each of the first and the second transformers and the second current flowing through each of the first and the second resonance capacitors, calculating a difference between the first current and the second current detected respectively in each of the first and second separately-excited inverters, and obtaining the tube current based on the difference, and wherein the control is exerted by changing a frequency of each of the first and the second driving voltages for setting so that the tube current maintains the predetermined value, based on the obtained result.

Also, a preferable mode is one wherein the detecting of the tube current includes detecting respectively the first current of a low-voltage side at the transformer secondary side of each of the first and the second transformers and the second current flowing through each of the first and the second resonance capacitors, calculating a difference between the first current and the second current detected respectively in each of the first and second separately-excited inverters, and obtaining the tube current based on the difference, and wherein the control is exerted by changing a duty ratio of each of the first and the second driving voltages for setting so that the tube current maintains the predetermined value, based on the obtained result.

Also, a preferable mode is one wherein the detecting of the tube current includes detecting respectively a temperature of the cold cathode tube, the first current of a low-voltage side at the transformer secondary side of each of the first and the second transformers and the second current flowing through each of the first and the second resonance capacitors, and detecting the tube current flowing through the cold cathode tube, based on the detected first current, the detected second current, and the detected temperature of the cold cathode tube.

Also, a preferable mode is one that wherein further includes:

detecting an output voltage of the transformer secondary side of each of the first and the second transformers, and stopping operations of the first and the second separately-excited inverters when an abnormality has occurred in at least one output voltage.

According to a third aspect of the present invention, there is provided an integrated circuit used as the tube current controlling unit in the cold cathode tube lighting device according to the first aspect.

In the foregoing third aspect, a preferable mode is one wherein the temperature detecting unit is incorporated.

Also, a preferable mode is one wherein the output voltage monitoring unit is incorporated.

According to a fourth aspect of the present invention, there is provided a cold cathode tube lighting device including:

a first separately-excited inverter which includes a first resonant circuit including a first transformer and a first resonance capacitor, connected to a first input terminal of a cold cathode tube;

a second separately-excited inverter which includes a second resonant circuit including a second transformer and a second resonance capacitor, connected to a second input terminal of the cold cathode tube;

wherein a first driving pulse voltage is generated by the first resonant circuit in the first separately-excited inverter, and a second driving pulse voltage is generated by the second resonant circuit in the second separately-excited inverter, and wherein the first and the second driving pulse voltages are 180° out of phase with each other, and are applied alternately to the first input terminal and the second input terminal of the cold cathode tube from a transformer secondary side of the first transformer and a transformer secondary side of the second transformer to light the cold cathode tube, the device further including:

a tube current controlling unit to detect a tube current flowing through the cold cathode tube, based on a first current flowing through the transformer secondary side of the first transformer or the second transformer, and on a second current flowing through the first resonance capacitor or the second resonance capacitor, and to exert control so that the tube current maintains a predetermined value, based on the detected result.

With the above configuration, a tube current controlling means is provided which detects, based on currents flowing through each of the transformer secondary sides of the transformers and through each of the resonance capacitors, a tube current flowing through a cold cathode tube and exerts control so that the tube current becomes a predetermined value and, therefore, luminance of the cold cathode tube can be kept constant.

With another configuration as above, the temperature detecting means to detect a temperature of the cold cathode tube is provided and the tube current controlling means detects a tube current flowing through the cold cathode tube based on a current flowing through each of the transformer secondary sides of the transformers and through each of the resonance capacitors and on a temperature of the cold cathode tube detected by the temperature detecting means and exerts control so that the tube current becomes a predetermined value and, therefore, luminance of the cold cathode tube can be kept constant with higher accuracy.

With another configuration as above, the output voltage monitoring means is provided which detects an output voltage from each of the transformer secondary sides of the transformers and, when an abnormality-occurs in at least one of the output voltages, stops operations of each separately-excited inverter and, therefore, each component making up the cold cathode tube can be protected and safety can be secured.

The present invention can be applied generally in the case where a cold cathode tube is driven by applying voltages to input terminals on its both sides.

BRIEF DESCRIPTION OF THE DRAWINGS

The above and other objects, advantages, and features of the present invention will be more apparent from the following description taken in conjunction with the accompanying drawings in which:

FIG. 6 is a block diagram showing electrical configurations of main components of a cold cathode tube lighting device according to a fourth embodiment of the present invention;

DETAILED DESCRIPTION OF THE PREFERRED EMBODIMENTS

Best modes of carrying out the present invention will be described in further detail using various embodiments with reference to the accompanying drawings. A cold cathode tube lighting device is provided in which a first current flowing through each of the transformer secondary sides of transformers is detected by a tube current detecting circuit and a second current flowing through each of resonance capacitors is detected also by the tube current detecting circuit and a difference between the first current and second current is calculated for each of separately-excited inverters and, based on the difference, a tube current flowing through a cold cathode tube is obtained, and a frequency or a duty ratio of a driving pulse voltage is changed for setting so that the tube current becomes a predetermined value.

First Embodiment

Figure 1:
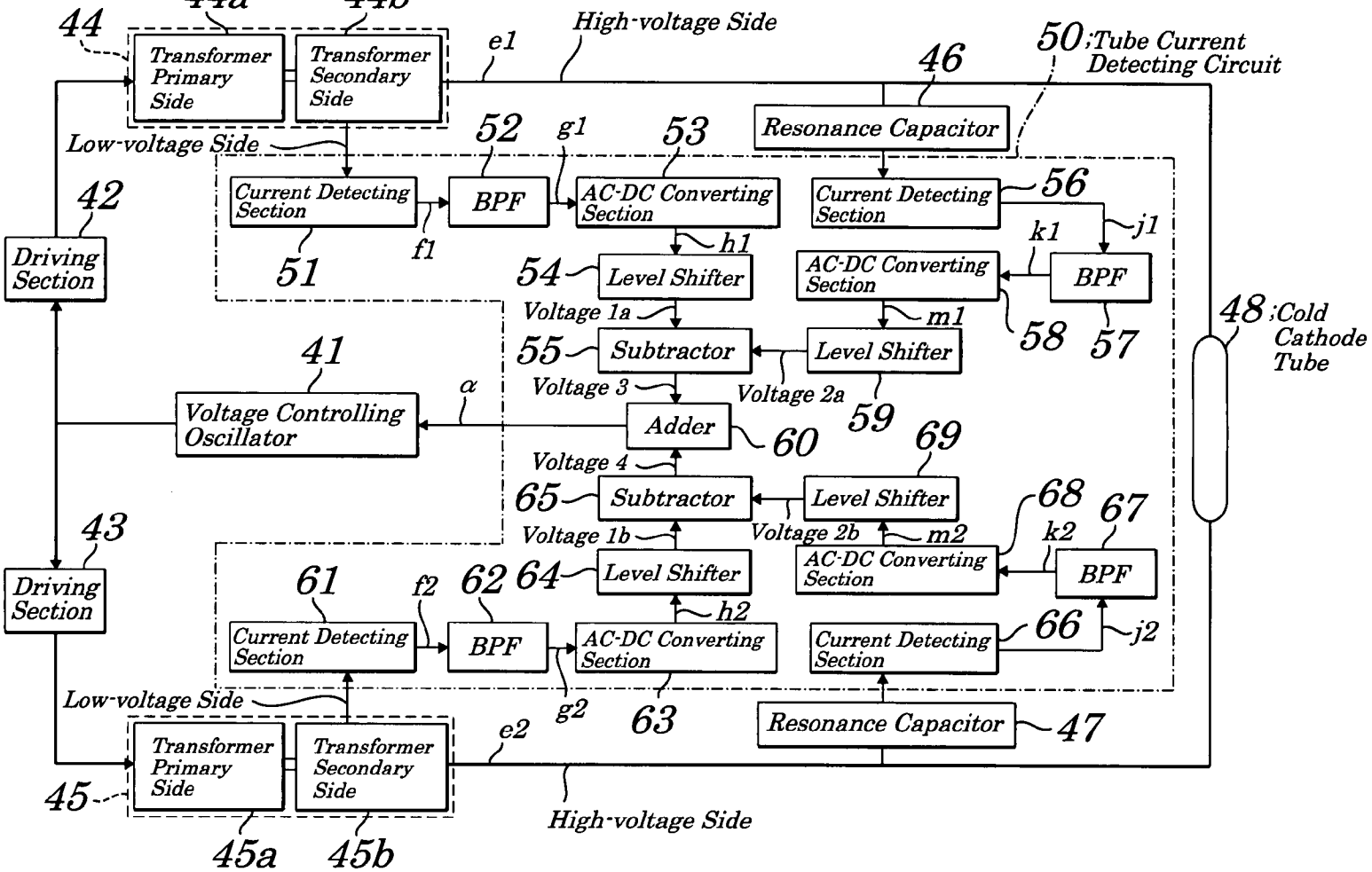
FIG. 1 is a block diagram showing electrical configurations of main components of a cold cathode tube lighting device according to a first embodiment of the present invention.

FIG. 1 is a block diagram showing electrical configurations of main components of a cold cathode tube lighting device according to the first embodiment of the present invention. The cold cathode tube lighting device of the first embodiment includes, as shown in FIG. 1, a voltage controlling oscillator 41, driving sections 42 and 43, transformers 44 and 45, resonant capacitors 46 and 47, and a tube current detecting circuit 50. To output sides of the transformers 44 and 45 is connected a cold cathode tube 48. The voltage controlling oscillator 41 oscillates at a frequency corresponding to a voltage "α" to be output from the tube current detecting circuit 50.

Each of the driving sections 42 and 43 generates a high-frequency voltage having a frequency to be set by the voltage controlling oscillator 41. Each of the transformers 44 and 45 inputs the high-frequency voltage fed from each of the driving sections 42 and 43 to each of transformer primary sides 44*a* and 45*a*. Driving pulse voltages "e1" and "e2", which are 180° out of phase with each other, are output from high-voltage sides on the transformer secondary sides 44*b* and 45*b* of the transformers 44 and 45, respectively. Each of the resonance capacitors 46 and 47 makes up a resonant circuit according to a combination with an inductance on each of the transformer secondary sides 44*b* and 45*b* of the transformers 44 and 45. The driving section 42, transformer 44, and resonance capacitor 46 make up one separately-excited inverter and the driving section 43, transformer 45, and resonance capacitor make up another separately-excited inverter; that is, the cold cathode tube lighting device includes two separately-excited inverters.

The tube current detecting circuit 50 detects a tube current flowing through the cold cathode tube 48 based on currents flowing through each of the transformer secondary sides 44*b* and 45*b* of the transformers 44 and 45 and on currents flowing through each of the resonance capacitors 46 and 47, respectively. That is, the tube current detecting circuit 50 includes current detecting sections 51 and 61, BPFs (Band Pass Filters) 52 and 62, AC-DC (Alternating Current-Direct Current) converting sections 53 and 63, level shifters 54 and 64, subtractors 55 and 65, current detecting sections 56 and 66, BPFs 57 and 67, AC-DC converting sections 58 and 68, level shifters 59 and 69, and adder 60. The current detecting section 51 detects a first current flowing through the transformer secondary side 44*b* of the transformer 44 from a low-voltage side on the transformer secondary side 44*b* and makes a current-to-voltage conversion of the detected current to output the voltage as an output signal "f1", whereas the current detecting section 61 detects a first current flowing through the transformer secondary side 45*b* of the transformer 45 from a low-voltage side on the transformer secondary side 45*b* and makes a current-to-voltage conversion of the detected current to output the voltage as an output signal "f2". The BPFs 52 and 62 remove noise components contained in the output signals "f1" and "f2" and allow only frequency components contained in the driving pulse voltages "e1" and "e2" to pass to output signals "g1" and "g2", respectively. The AC-DC converting sections 53 and 63 make AC to DC conversions of the output signals "g1" and "g2" and output the converted signals as output signals "h1" and "h2", respectively. The level shifters 54 and 64 level-shift the output signals "h1" and "h2" so as to have a predetermined value and output the level-shifted signals as voltages "1*a*" and "1*b*", respectively.

The current detecting sections 56 and 66 detect a second current flowing through the resonance capacitors 46 and 47 and make a current-voltage conversion of the detected current to output the voltage as output signals "j1" and "j2", respectively. The BPFs 57 and 67 remove noise components contained in the output signals "j1" and "j2" and allow only frequency components contained in the driving pulse voltages "e1" and "e2" to pass to output signals "k1" and "k2", respectively. The AC-DC converting sections 58 and 68 make AC to DC conversions of the output signals "k1" and "k2" and output the converted signals as output signals "m1" and "m2", respectively. The level shifters 59 and 69 level-shift the output signals "k1" and "k2" so as to have a predetermined value and output the level-shifted signals as voltages "2*a*" and "2*b*", respectively. The subtractor 55 subtracts the voltage "2*a*" output from the level shifter 59 from the voltage "1*a*" output from the level shifter 54 to output a voltage 3 corresponding to a current flowing from the transformer 44 to the cold cathode tube 48. The subtractor 65 subtracts the voltage "2*b*" output from the level shifter 69 from the voltage "1*b*" output from the level shifter 64 to output a voltage 4 corresponding to a current flowing from the transformer 45 to the cold cathode tube 48. The adder 60 adds the voltage 3 output from the subtractor 55 to the voltage 4 output from the subtractor 65 to output a voltage "α".

The tube current detecting circuit 50 detects a first current flowing through each of the transformer secondary sides 44*b* and 45*b* of the transformers 44 and 45 from a low-voltage side of each of the transformer secondary sides 44*b* and 45*b* and detects a second current flowing through each of the resonance capacitors 46 and 47 and then calculates a difference between the first and second currents for every separately-excited inverter and, based on the difference, obtains a tube current of the cold cathode tube 48 and outputs a voltage "α" corresponding to the tube current. A tube current controlling means made up of the tube current detecting circuit 50 and the voltage controlling oscillator 41 changes frequencies of the driving pulse voltages "e1" and "e2" for setting so that a tube current of the cold cathode tube 48 becomes a predetermined value. Moreover, both the voltage controlling oscillator 41 and tube current detecting circuit 50 are constructed as a one-chip integrated circuit.

In the driving method to be applied to the cold cathode tube lighting device, based on a current flowing through each of the transformer secondary sides 44*b* and 45*b* of the transformers 44 and 45 and on a current flowing through each of the resonance capacitors 46 and 47, a tube current flowing through the cold cathode tube 48 is detected and control is exerted so that the tube current becomes a predetermined value. That is, in the cold cathode tube lighting device, a oscillation frequency of the voltage controlling oscillator 41 is set at a frequency close to a resonant frequency of a resonant circuit made up of an inductance on each of the transformer secondary sides 44*b* and 45*b* of the transformers 44 and 45 and of each of the resonance capacitors 46 and 47. Then, high-frequency voltages each having a frequency to be set by the voltage controlling oscillator 41 is generated by the driving sections 42 and 43. The high-frequency voltages are input to each of the transformer primary sides 44*a* and 45*a* of the transformers 44 and 45 and driving pulse voltages "e1" and "e2", which are 180° out of phase with each other, are output from high-voltage sides of the transformer secondary sides 44*b* and 45*b* of the transformers 44 and 45, respectively. Each of the driving pulse voltages "e1" and "e2" is applied to each of input terminals on both ends of the cold cathode tube 48 to light the cold cathode tube 48.

In this case, the first current flowing through each of the transformer secondary sides 44*b* and 45*b* of the transformers 44 and 45 is detected from each of the low-voltage sides on the transformer secondary sides 44*b* and 45*b* and a current-to-voltage conversion of the detected current is made so that the output signals "f1" and "f2" are output, respectively. Due to the inductance and distributed capacity of the transformers 44 and 45, noises superimpose on the output signals "f1" and "f2" and, therefore, the noise components are removed by the BPFs 52 and 62 which allow only the frequency components contained in the driving pulse voltages "e1" and "e2" to pass, respectively, and then the output signals "g1" and "g2" are output from the BPFs 52 and 62 respectively. The voltages of the output signals "g1" and "g2" are converted by the AC-DC converting sections 53 and 63 from an alternating current voltage to a direct current voltage and output signals "h1" and "h2" are output from the AC-DC converting sections 53 and 63, respectively. The output signals h1 and h2 are level-shifted by the level shifters 54 and 64 so that the output signals "h1" and "h2" have a predetermined value, and the voltages "1*a*" and "1*b*" are output from the level shifters 54 and 64, respectively.

Also, a second current flowing through each of the resonance capacitors 46 and 47 is detected by each of the current detecting sections 56 and 66 and a current-voltage conversion of the detected current is made to output the output signals "j1" and "j2", respectively. Noise components contained in the output signals "j1" and "j2" are removed by the BPFs 57 and 67 and only frequency components contained in the driving pulse voltages "e1" and "e2" are allowed to pass by the BPFs 57 and 67, respectively, so that the output signals "k1" and "k2" are output. The voltages of the output signals "k1" and "k2" are converted by the AC-DC converting sections 58 and 68 from an alternating current voltage to a direct current voltage and the output signals "m1" and "m2" are output from the AC-DC converting sections 58 and 68, respectively. The output signals "m1" and "m2" are level-shifted by the level shifters 59 and 69 so that the output signals "m1" and "m2" have a predetermined value, and the voltages "2*a*" and "*b*" are output from the level shifters 59 and 69, respectively.

The voltage 2*a* output from the level shifter 59 is subtracted by the subtractor 55 from the voltage "*a*" output from the level shifter 54 and, as a result, a voltage 3 is output. Also, the voltage 2*b* output from the level shifter 69 is subtracted by the subtractor 65 from the voltage 1*b* output from the level shifter 64 and, as a result, the voltage 4 is output. The voltage 3 is added to the voltage 4 by the adder 60 and the voltage "α" is output from the adder 60. The voltage "α" corresponds to a tube current of the cold cathode tube 48 and is input to the voltage controlling oscillator 41. The voltage controlling oscillator 41 changes its oscillation frequency, as appropriate, so that a tube current flowing through the cold cathode tube 48 becomes a predetermined value and the driving sections 42 and 43 output high-frequency voltages corresponding to the oscillation frequency. Each of the high-frequency voltages is input to each of the transformer primary sides 44*a* and 45*a* of the transformers 44 and 45 and each of driving pulse voltages "e1" and "e2", which are 180° out of phase with each other, is output from a high-voltage side on each of the transformer secondary sides 44*b* and 45*b* of the transformers 44 and 45 and is input to each of input terminals of both sides of the cold cathode tube 48. This makes a tube current of the cold cathode tube 48 become a predetermined value and enables luminance of the cold cathode tube 48 to be kept constant.

As described above, according to the first embodiment, a first current flowing through each of the transformer secondary sides 44*b* and 45*b* of the transformers 44 and 45 is detected by the tube current detecting circuit 50 from a low-voltage side of each of the transformer secondary sides 44*b* and 45*b* and a second current flowing through the resonance capacitors 46 and 47 is detected by the tube current detecting circuit 50 and a difference between the first current and second current is calculated for every separately-excited inverter and, based on the difference, a tube current of the cold cathode tube 48 is obtained and frequencies of the driving pulse voltages "e1" and "e2" are changed by the voltage controlling oscillator 41 for setting so that the tube current becomes a predetermined value and, therefore, it is possible to keep luminance of the cold cathode tube 48 constant.

Second Embodiment

Figure 2:
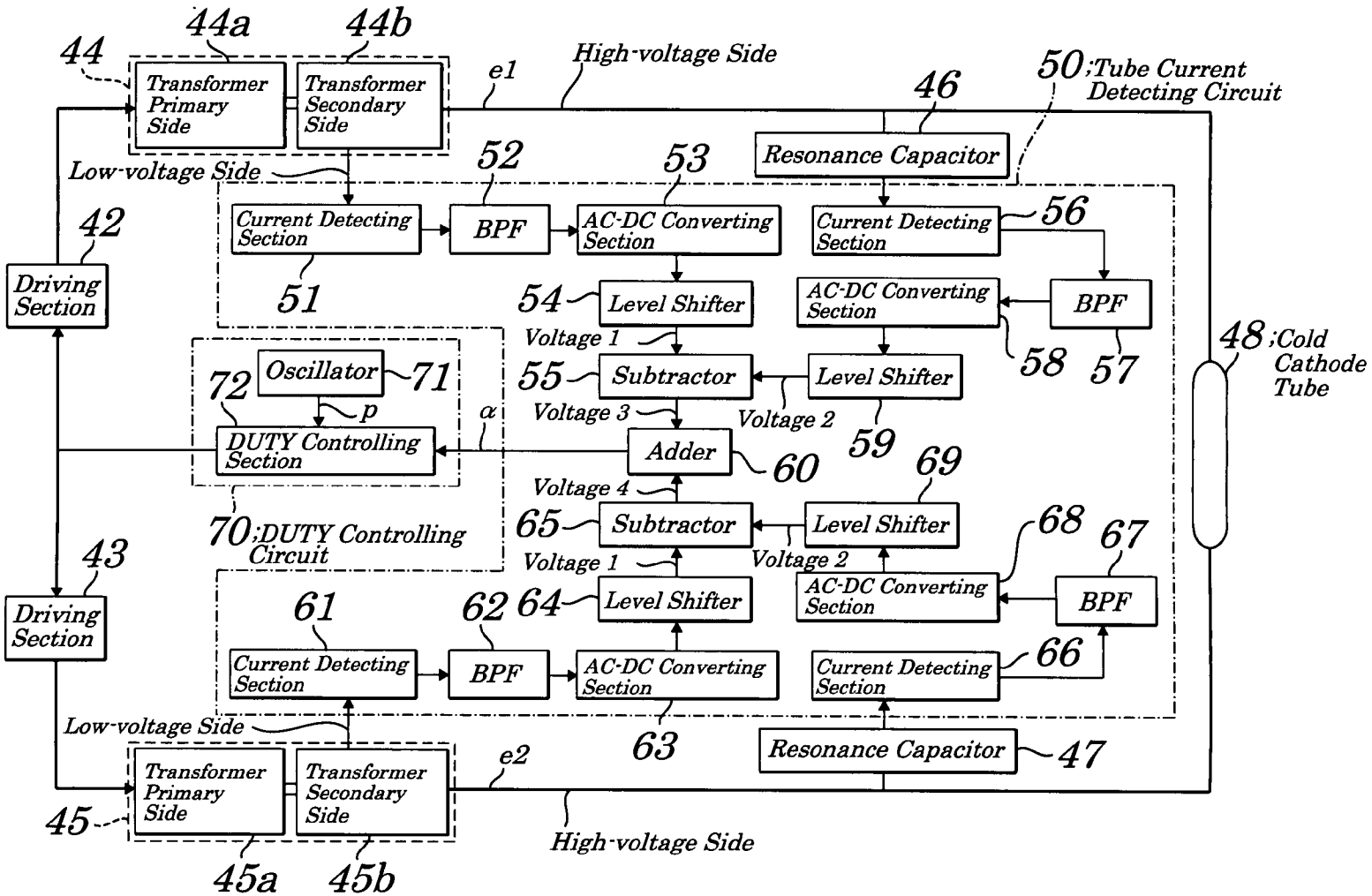
FIG. 2 is a block diagram showing electrical configurations of main components of a cold cathode tube lighting device according to a second embodiment of the present invention.

FIG. 2 is a block diagram showing electrical configurations of main components of a cold cathode tube lighting device according to the second embodiment of the present invention and same reference numbers are assigned to components having the same functions as those shown in FIG. 1 in the first embodiment. In the cold cathode tube lighting device of the second embodiment, as shown in FIG. 2, instead of the voltage controlling oscillator 41, a DUTY controlling circuit 70 is mounted. The DUTY controlling circuit 70 is made up of an oscillator 71 and a DUTY controlling section 72. The oscillator 71 generates an output signal "p" having a predetermined frequency and its oscillation frequency is set, in a fixed manner, at a frequency close to a resonant frequency of a resonant circuit made up of an inductance on each of transformer secondary sides 44*b* and 45*b* of the transformers 44 and 45 and of each of resonance capacitors 46 and 47.

The DUTY controlling section 72 controls a duty ratio of the output signal "p" of the oscillator 71 in a manner to correspond to a voltage "α" to be output from a tube current detecting circuit 50. The DUTY controlling circuit 70 and the tube current detecting circuit 50 make up a tube current controlling means which changes a duty ratio of driving pulse voltages "e1" and "e2" for setting so that a tube current of a cold cathode tube 48 becomes a predetermined value. Moreover, the DUTY controlling circuit 70 and tube current detecting circuit 50 are constructed as a one-chip integrated circuit. Other configurations are the same as those shown in FIG. 1.

Figure 3:
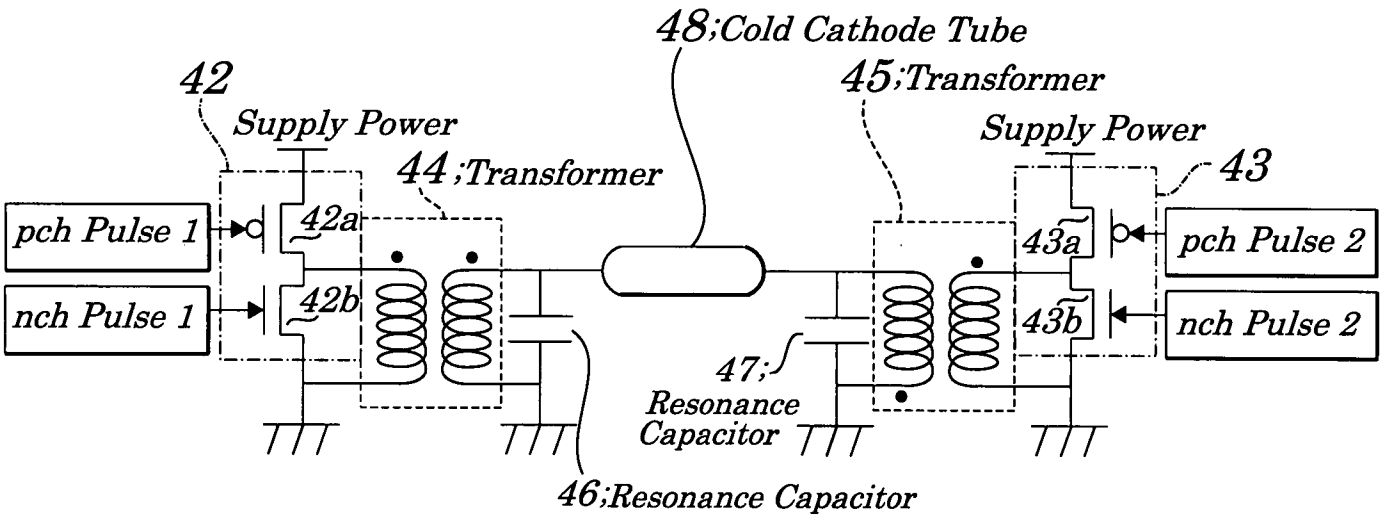
FIG. 3 is a schematic diagram showing configurations of the driving sections, transformers, resonance capacitors, and cold cathode tube taken from FIG. 2.

FIG. 3 is a diagram showing configurations of driving sections 42 and 43, the transformers 44 and 45, the resonance capacitors 46 and 47, and the cold cathode tube 48 taken from FIG. 2. As shown in FIG. 3, the driving section 42 has a p-channel MOSFET (Metal Oxide Field Effect Transistor) (hereinafter "pMOS") 42*a* and an n-channel MOSFET (hereinafter "nMOS) 42*b*. The pMOS 42*a* is controlled ON/OFF by a pch (p-channel) pulse 1 output from the DUTY controlling section 72, whereas the nMOS 42*b* is controlled ON/OFF by an nch (n-channel) pulse 1 output from the DUTY controlling section 72. The driving section 43 has a pMOS 43*a* and an nMOS 43*b*. The PMOS 43*a* is controlled ON/OFF by a pch pulse 2 output from the DUTY controlling section 72 and the nMOS 43*b* is controlled ON/OFF by an nch pulse 2 output from the DUTY controlling section 72.

Figure 4:
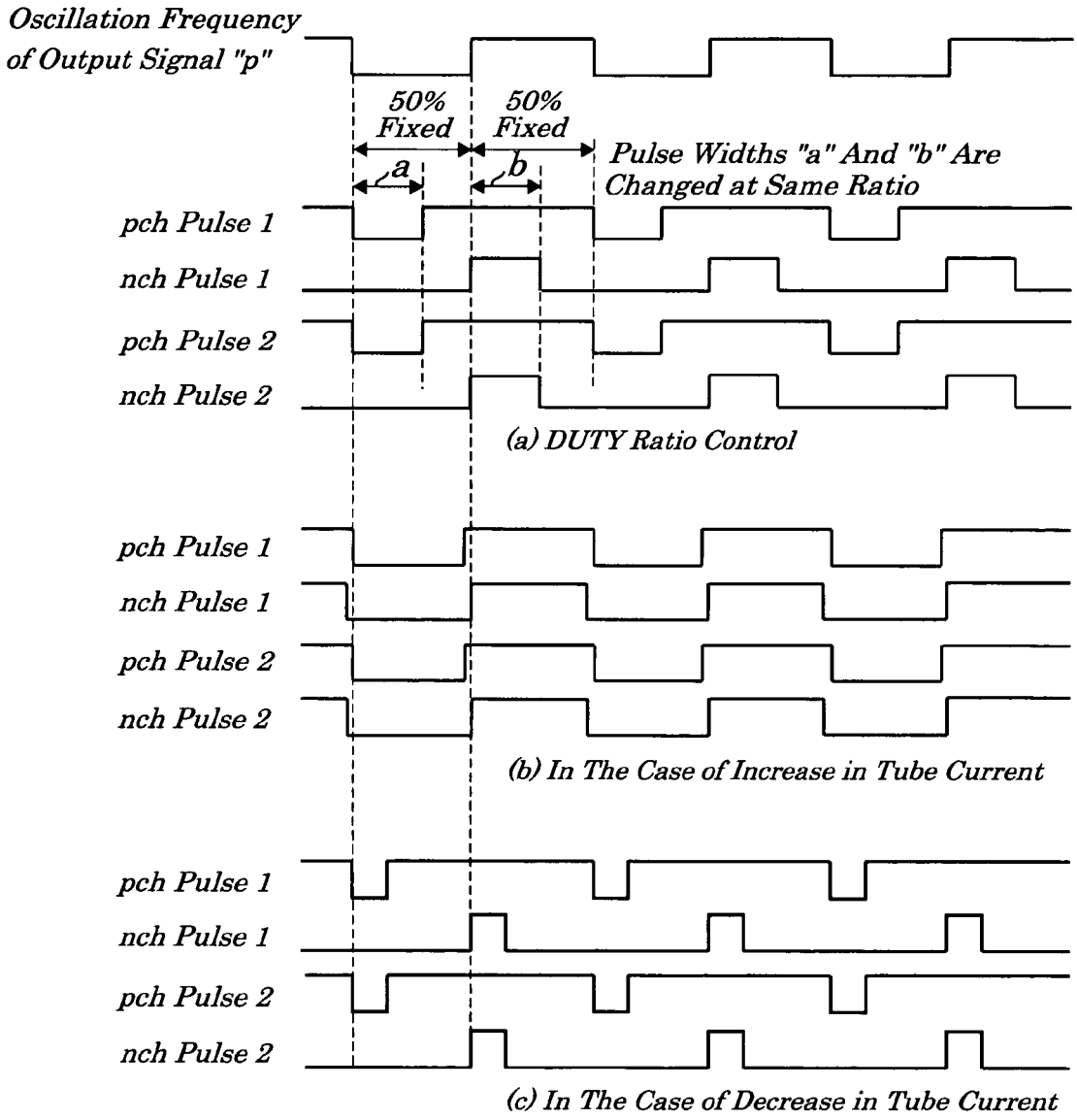
FIG. 4 is a time chart explaining operations of components shown in FIG. 3.

FIG. 4 is a time chart explaining operations of components shown in FIG. 3. Wit reference to FIG. 4, the driving method to be applied to the cold cathode tube lighting device of the second embodiment is described below. As shown in (a) of FIG. 4, control is exerted by the DUTY controlling section 72 so that pulse widths of the pch pulses 1 and 2 and of the nch pulses 1 and 2 are changed at the same ratio and time periods during which the pMOSs 42*a* and 43*a* and nMOSs 42*b* and 43*b* are turned ON are made equal and the ON time periods are controlled in a manner corresponding to a voltage "α" to be output from the tube current detecting circuit 50, which makes a tube current of the cold cathode tube 48 become a predetermined value. For example, to increase the tube current, as shown in (b) of FIG. 4, the ON time period is made longer and, to decrease the tube current, as shown in (c) of FIG. 4, the ON time period is made shorter. By this control, a tube current of the cold cathode tube 48 becomes a predetermined value and luminance of the cold cathode tube 48 is kept constant.

As described above, according to the second embodiment, duty ratios of the driving pulse voltages "e1" and "e2" are changed for setting so that a tube current of the cold cathode tube 48 becomes a predetermined value and, therefore, luminance of the cold cathode tube 48 can be kept constant.

Luminance of the cold cathode tube 48 changes also depending on a tube wall temperature of the cold cathode tube 48. In the following third embodiment, a cold cathode tube lighting device in which a tube current is controlled in a manner to correspond to the tube wall temperature is explained.

Third Embodiment

Figure 5:
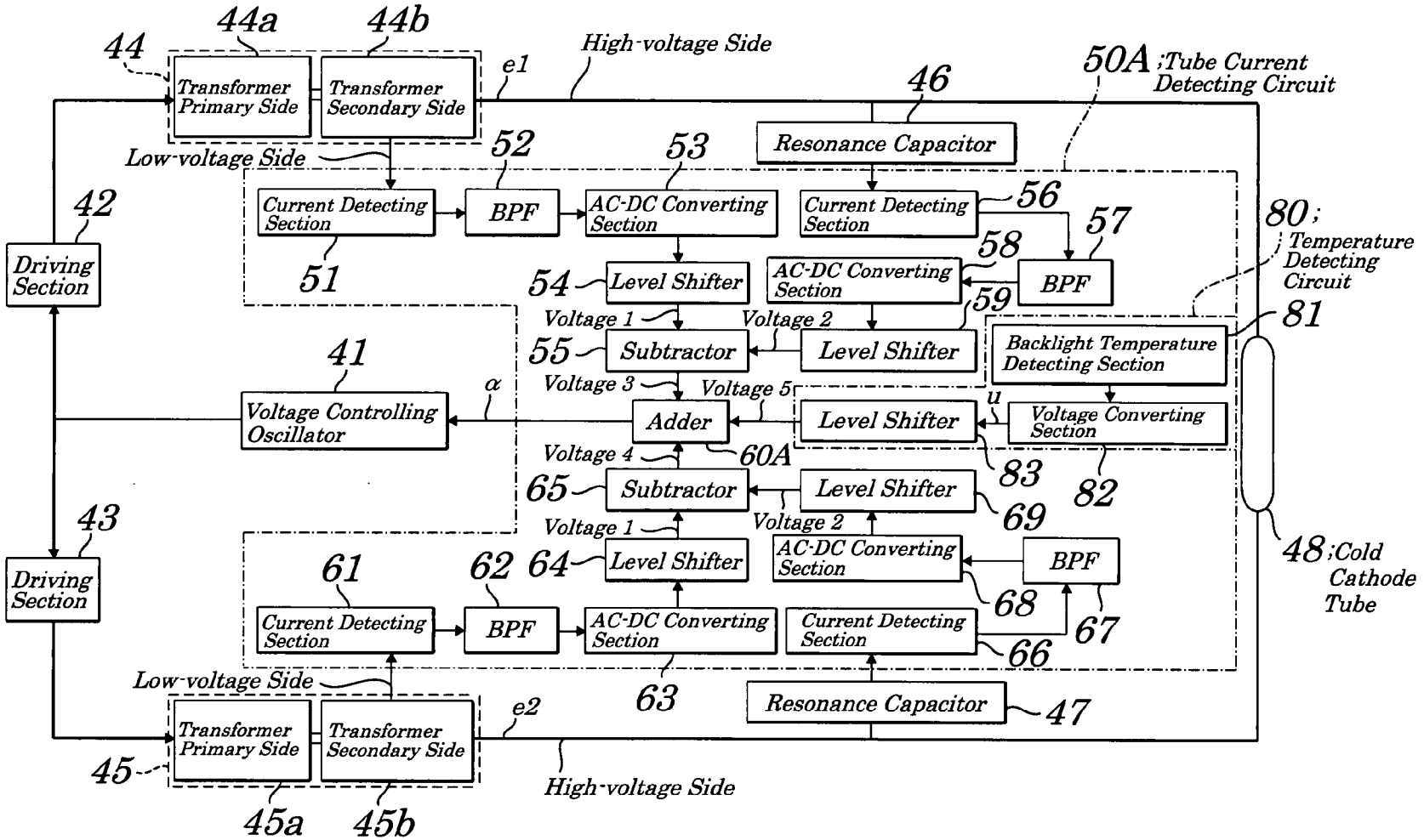
FIG. 5 is a block diagram showing electrical configurations of main components of a cold cathode tube lighting device according to a third embodiment of the present invention.

FIG. 5 is a block diagram showing electrical configurations of main components of a cold cathode tube lighting device according to the third embodiment of the present invention. The cold cathode tube lighting device of the third embodiment has, instead of the tube current detecting circuit 50 shown in FIG. 1, a tube current detecting circuit 50A having a new additional function. The tube current detecting circuit 50A has an additional temperature detecting circuit 80 and an adder 60A ,instead of the adder 60 shown in FIG. 1. The temperature detecting circuit 80 is made up of a backlight temperature detecting section 81, a voltage converting section 82, and a level shifter 83. The backlight temperature detecting section 81 detects a tube wall temperature of a cold cathode tube 48. The voltage converting section 82 converts a tube wall temperature detected by the backlight temperature detecting section 81 into a voltage "u". The level shifter 83 level-shifts the voltage "u" so as to become a predetermined value and outputs the level-shifted voltage as a voltage 5. The adder 60A adds the voltage 5, a voltage 3 to be fed from a subtractor 55, a voltage 4 to be fed from a subtractor 65 and outputs the added voltages as a voltage "α".

The tube current detecting circuit 50A detects a first current flowing through each of transformer secondary sides 44*b* and 45*b* of the transformers 44 and 45 from a low-voltage side of each of the transformer secondary sides 44*b* and 45*b* and a second current flowing through each of resonance capacitors 46 and 47 and calculates a difference between the first current and second current for every separately-excited inverter and obtains a tube current of the cold cathode tube 48 based on the difference and on a tube wall temperature of the cold cathode tube 48 detected by the temperature detecting circuit 80, and outputs the voltage "α" corresponding to the tube current. A tube current controlling means made up of the tube current detecting circuit 50A and a voltage controlling oscillator 41 changes frequencies of the driving pulse voltages "e1" and "e2" for setting so that a tube current of the cold cathode tube 48 becomes a predetermined value. Moreover, both the voltage controlling oscillator 41 and tube current detecting circuit 50A are constructed as a one-chip integrated circuit. Other configurations are the same as those shown in FIG. 1.

In the cold cathode tube lighting device of the third embodiment, a first current flowing through each of the transformer secondary sides 44*b* and 45*b* of the transformers 44 and 45 is detected from a low-voltage side of each of the transformer secondary sides 44*b* and 45*b* and a second current flowing through each of the resonance capacitors 46 and 47 is detected and a difference between the first current and second current is calculated for every separately-excited inverter and a tube current of the cold cathode tube 48 is obtained based on the difference and on a tube wall temperature of the cold cathode tube 48 detected by the temperature detecting circuit 80, and frequencies of the driving pulse voltages "e1" and "e2" are changed for setting so that a tube current of the cold cathode tube 48 becomes a predetermined value and, therefore, luminance of the cold cathode tube 48 is kept constant with a degree of accuracy being higher than the case of the first embodiment.

Fourth Embodiment

FIG. 6 is a block diagram showing electrical configurations of main components of a cold cathode tube lighting device according to the fourth embodiment of the present invention and same reference numbers are assigned to components having the same functions as those shown in FIG. 2 in the second embodiment as those shown in FIG. 5 in the third embodiment. The cold cathode tube lighting device of the fourth embodiment, as shown in FIG. 6, has a tube current detecting circuit 50A shown in FIG. 5, instead of a tube current detecting circuit 50. A tube current controlling means made up of the tube current detecting circuit 50A and a DUTY controlling circuit 70 changes frequencies of driving pulse voltages "e1" and "e2" for setting so that a tube current of a cold cathode tube 48 becomes a predetermined value. Moreover, the tube current detecting circuit 50A and the DUTY controlling circuit 70 are constructed as a one-chip integrated circuit.

In the cold cathode tube lighting device of the fourth embodiment, a first current flowing through each of transformer secondary sides 44*b* and 45*b* of transformers 44 and 45 is detected from a low-voltage side of each of the transformer secondary sides 44*b* and 45*b* and a second current flowing through each of resonance capacitors 46 and 47 is detected and a difference between the first current and second current is calculated for every separately-excited inverter and a tube current of the cold cathode tube 48 is obtained, based on the difference and on a tube wall temperature of the cold cathode tube 48 detected by a temperature detecting circuit 80 and frequencies of the driving pulse voltages "e1" and "e2" are changed for setting so that a tube current of the cold cathode tube 48 becomes a predetermined value and, therefore, luminance of the cold cathode tube 48 is kept constant with a degree of accuracy being higher than the case of the second embodiment.

Fifth Embodiment

Figure 7:
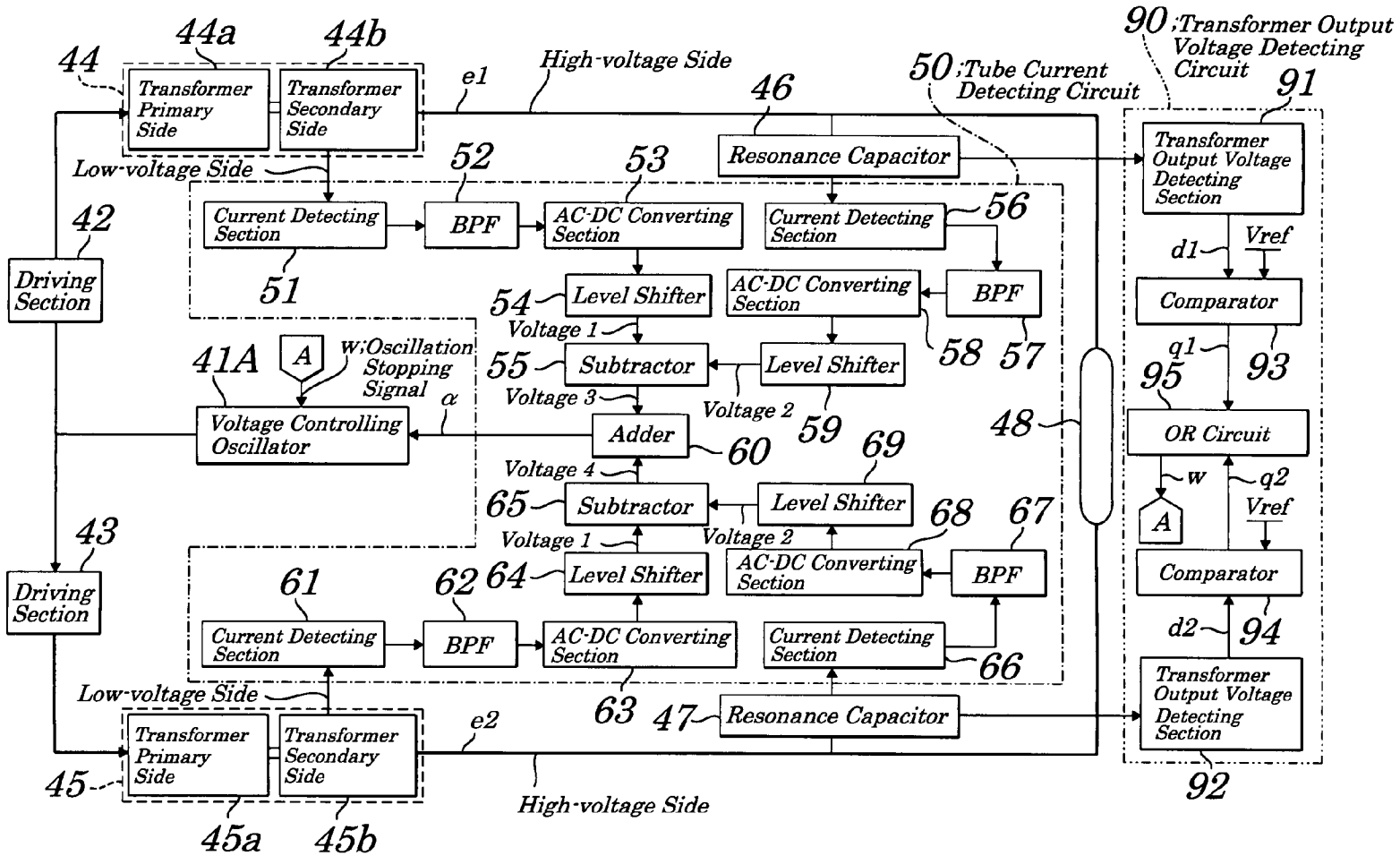
FIG. 7 is a block diagram showing electrical configurations of main components of a cold cathode tube lighting device according to a fifth embodiment of the present invention.

FIG. 7 is a block diagram showing electrical configurations of main components of a cold cathode tube lighting device according to the fifth embodiment of the present invention. The cold cathode tube lighting device of the embodiment, as shown in FIG. 7, has a transformer output voltage detecting circuit 90 and a voltage controlling oscillator 41A to stop oscillation when an oscillation stopping signal "w" is fed thereto from the transformer output voltage detecting circuit 90, instead of the voltage controlling oscillator 41 shown in FIG. 1. The transformer output voltage detecting circuit 90 includes transformer output voltage detecting sections 91 and 92, comparators 93 and 94, and an OR circuit 95. The transformer output voltage detecting sections 91 and 92 are made up of, for example, buffers, rectifying circuits or a like and detect driving pulse voltages "e1" and "e2" from resonance capacitors 46 and 47 respectively and output a mean value or peak value of each of the driving pulse voltages "e1" and "e2" as output signals "d1" and "d2", respectively.

The comparators 93 and 94 compare levels of the output signals "d1" and "d2" with a specified reference voltage "Vref" and output, when the output signals "d1" and "d2" become higher than the reference voltage "Vref", active-mode (for example, high-level, H) output signals "q1" and "q2", respectively. The OR circuit 95, when at least one signal out of the output signals "q1" and "q2" goes high (H), outputs an oscillation stopping signal "w". The transformer output voltage detecting circuit 90 makes up an output voltage monitoring means. Moreover, all the voltage controlling oscillator 41A, a tube current detecting circuit 50, and the transformer output voltage detecting circuit 90 are constructed as a one-chip integrated circuit.

In the cold cathode tube lighting device of the fifth embodiment, output voltages (driving pulse voltages "e1" and "e2") from transformer secondary sides 44*b* and 45*b* of transformers 44 and 45 are detected by the transformer output voltage detecting circuit 90 and, when at least one of the driving pulse voltages "e1" and "e2" abnormally becomes high, oscillation of the voltage controlling oscillator 41A is stopped, causing the stop of operations of each of the separately-excited inverters. As a result, the cold cathode tube lighting device of the fifth embodiment has an advantage, in addition to the advantage of the first embodiment, that each component making up the cold cathode tube lighting device is protected and its safety is secured.

Sixth Embodiment

Figure 8:
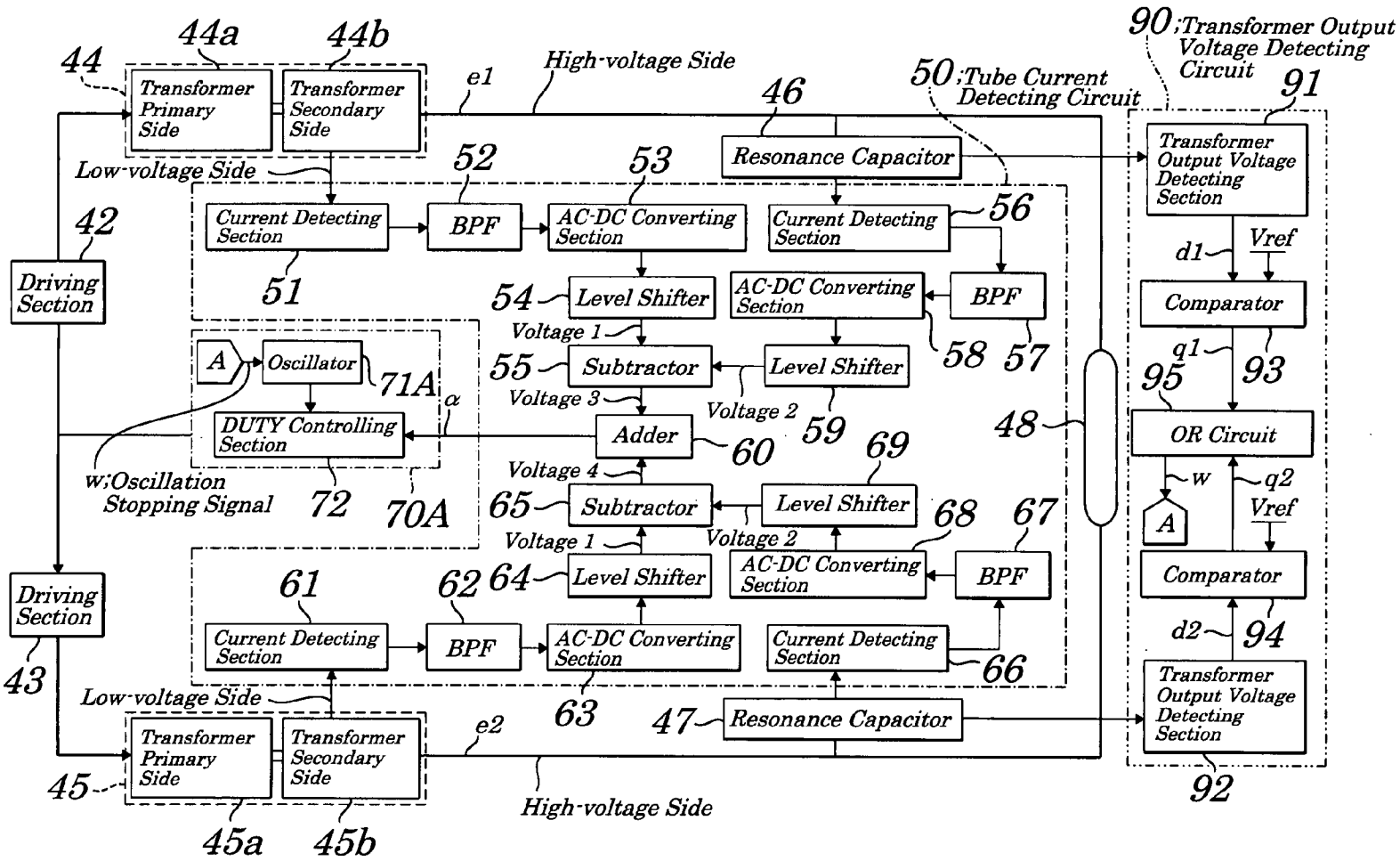
FIG. 8 is a block diagram showing electrical configurations of main components of a cold cathode tube lighting device according to a sixth embodiment of the present invention.

FIG. 8 is a block diagram showing electrical configurations of main components of a cold cathode tube lighting device according to the sixth embodiment of the present invention. The cold cathode tube lighting device of the sixth embodiment, as shown in FIG. 8, has a transformer output voltage detecting circuit 90 shown in FIG. 7 and a DUTY controlling circuit 70A, instead of the DUTY controlling circuit 70 shown in FIG. 7. The DUTY controlling circuit 70A has, instead of the oscillator 71 shown in FIG. 2, an oscillator 71A whose operations are stopped when an oscillation stopping signal "w" is fed from the transformer output voltage detecting circuit 90. Other configurations are the same as those in FIG. 2.

In the cold cathode tube lighting device of the sixth embodiment, output voltages (driving pulse voltages "e1" and "e2") from transformer secondary sides 44*b* and 45*b* of transformers 44 and 45 are detected by the transformer output voltage detecting circuit 90 and, when at least one of the driving pulse voltages "e1" and "e2" abnormally becomes high, operations of the DUTY controlling circuit 70A are stopped, causing the stop of operations of each of the separately-excited inverters. As a result, the cold cathode tube lighting device of the sixth embodiment has an advantage, in addition to the advantage of the first embodiment, that each component making up the cold cathode tube lighting device is protected and its safety is secured.

It is apparent that the present invention is not limited to the above embodiments but may be changed and modified without departing from the scope and spirit of the invention. For example, instead of the voltage controlling oscillator 41 shown in FIG. 5 explaining the third embodiment, the voltage controlling oscillator 41A shown in FIG. 7 explaining the fifth embodiment and the transformer output voltage detecting circuit 90 shown in FIG. 7 may be provided in the third embodiment. As a result, in addition to the advantage of the third embodiment itself, as in the case of the fifth embodiment, each component of the cold cathode tube lighting device can be protected and safety is secured as well. Moreover, in this case, the voltage controlling oscillator 41A, tube current detecting circuit 50A shown in FIG. 5, and transformer output voltage detecting circuit 90 may be constructed as a one-chip integrated circuit.

Also, instead of the DUTY controlling circuit 70 shown in FIG. 6 explaining the fourth embodiment, the DUTY controlling circuit 70A and the transformer output voltage detecting circuit 90 shown in FIG. 8 explaining the sixth embodiment may be provided. As a result, in addition to the advantage of the fourth embodiment itself, as in the case of the sixth embodiment, each component of the cold cathode tube lighting device can be protected and safety is secured as well. Moreover, in this case, the DUTY controlling circuit 70A, tube current detecting circuit 50A shown in FIG. 6, and transformer output voltage detecting circuit 90 may be constructed as a one-chip integrated circuit.

Figure 9:
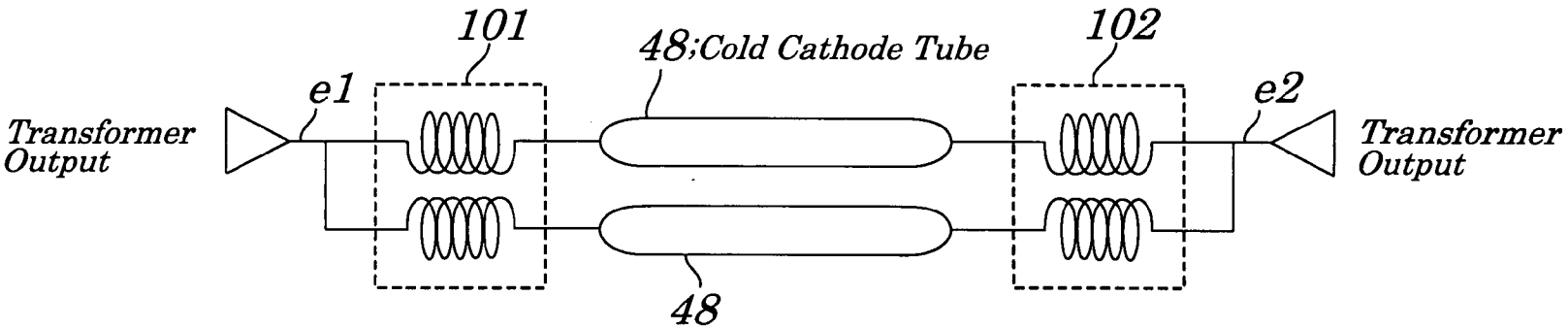
FIG. 9 is a schematic diagram showing electrical configurations when a plurality of cold cathode tubes is lit by the cold cathode tube lighting device according to any one of the first to the sixth embodiment.
Figure 10:
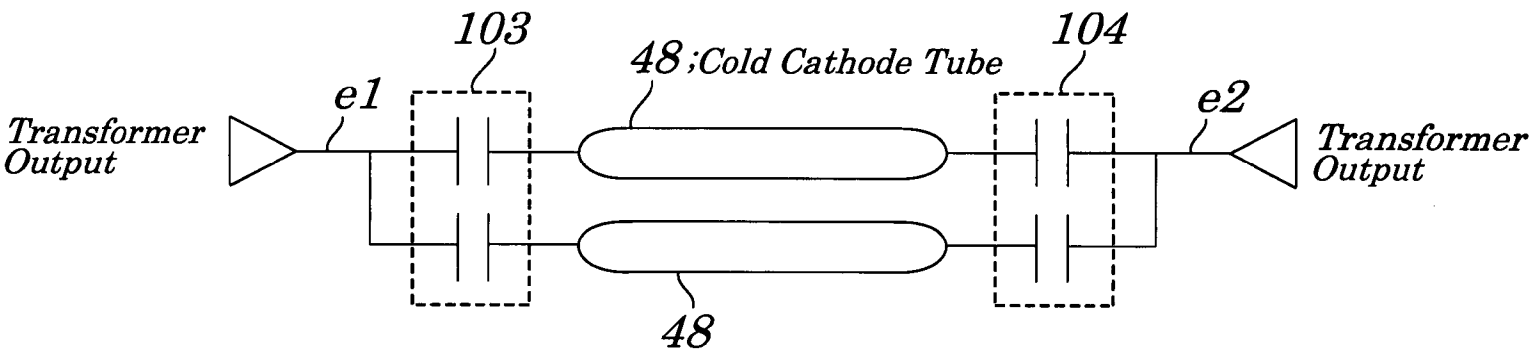
FIG. 10 is a schematic diagram showing another electrical configuration when a plurality of cold cathode tubes is lit by the cold cathode tube lighting device according to any one of the first to the sixth embodiment.
Figure 11:
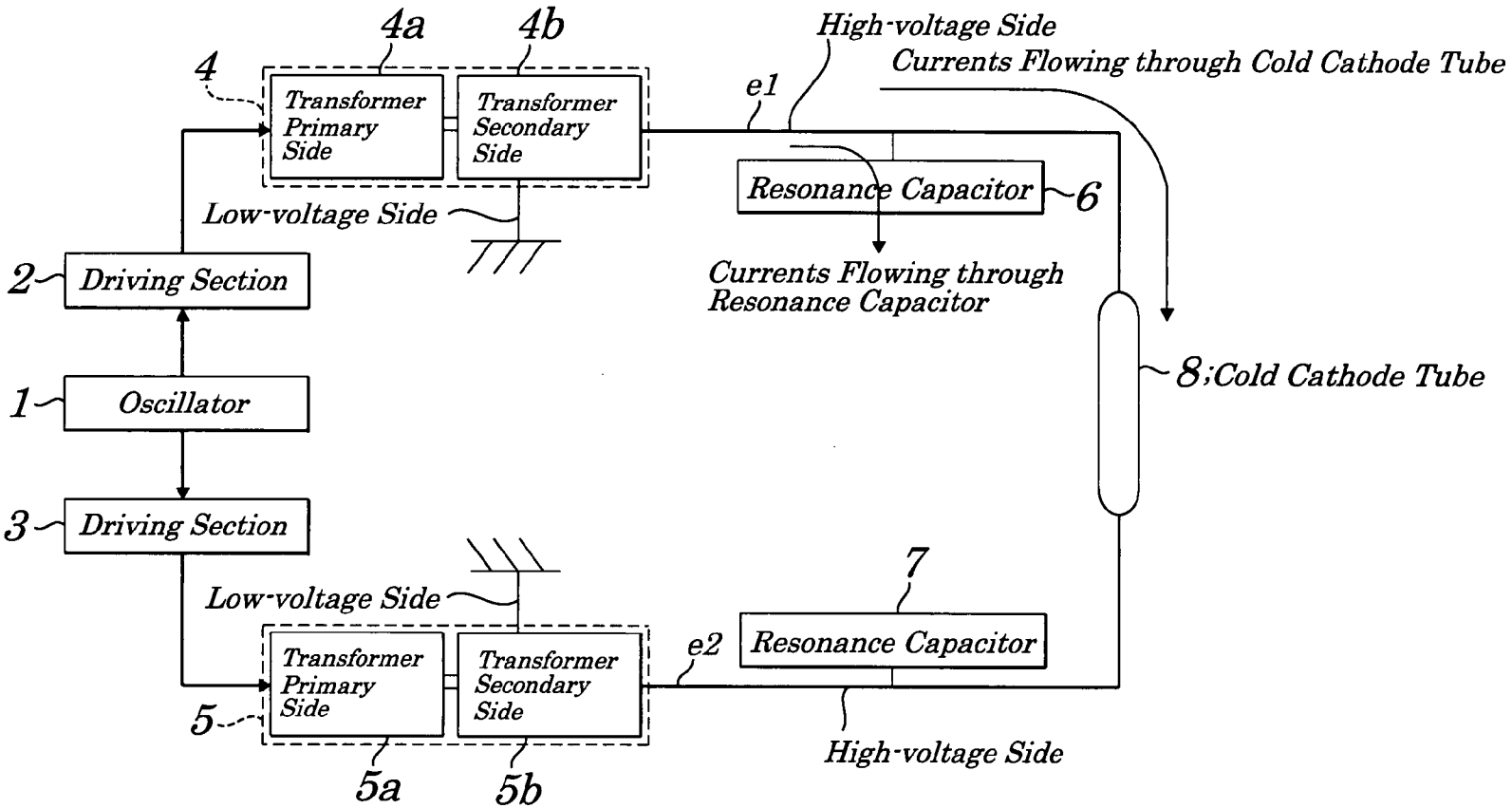
FIG.11 (PRIOR ART)
FIG. 11 is a block diagram showing electrical configurations of a conventional cold cathode tube lighting device.
Figure 12:
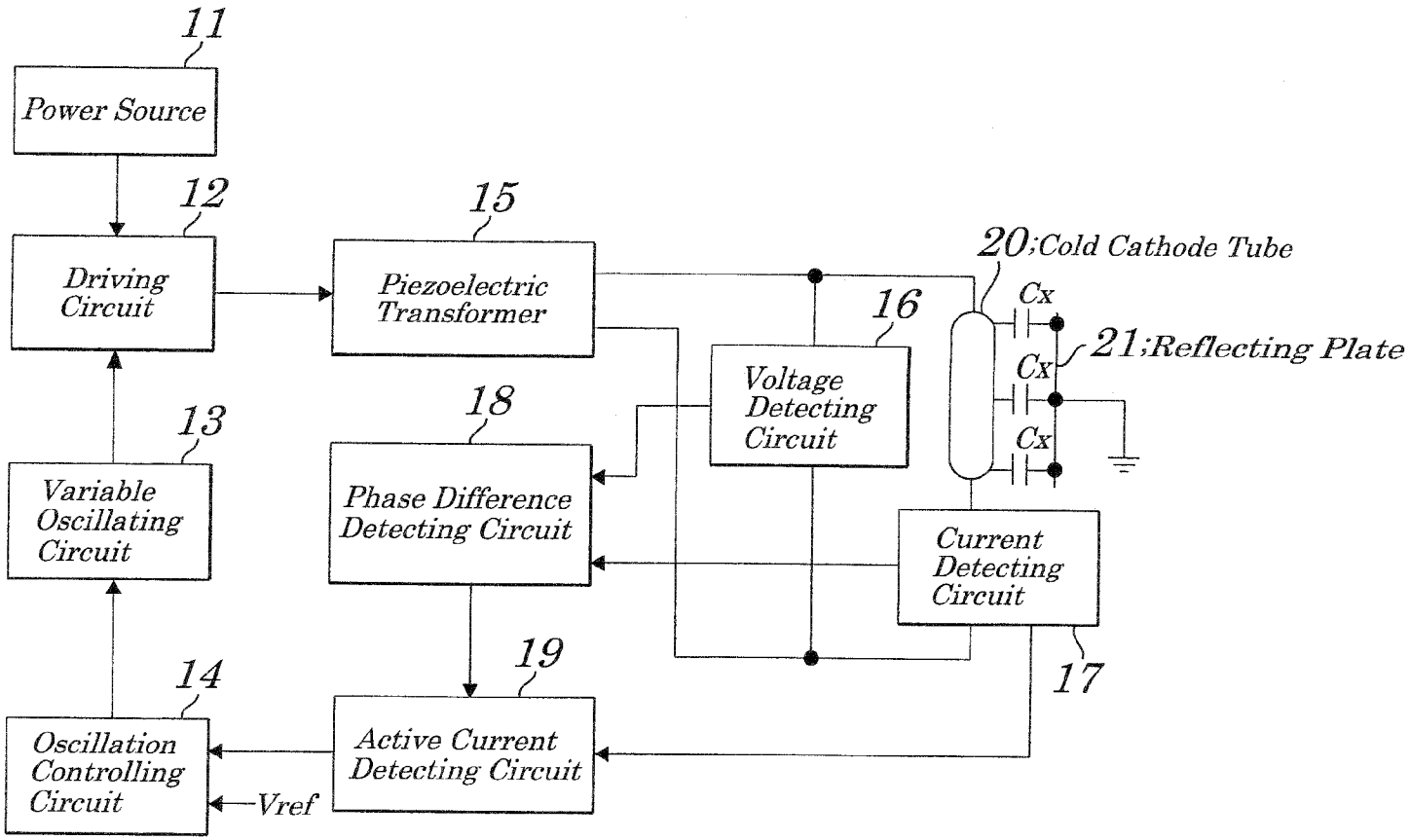
FIG. 12 (PRIOR ART)
FIG. 12 is a block diagram showing electrical configurations of a conventional piezoelectric transformer driving device disclosed in Patent Reference 1.
Figure 13:
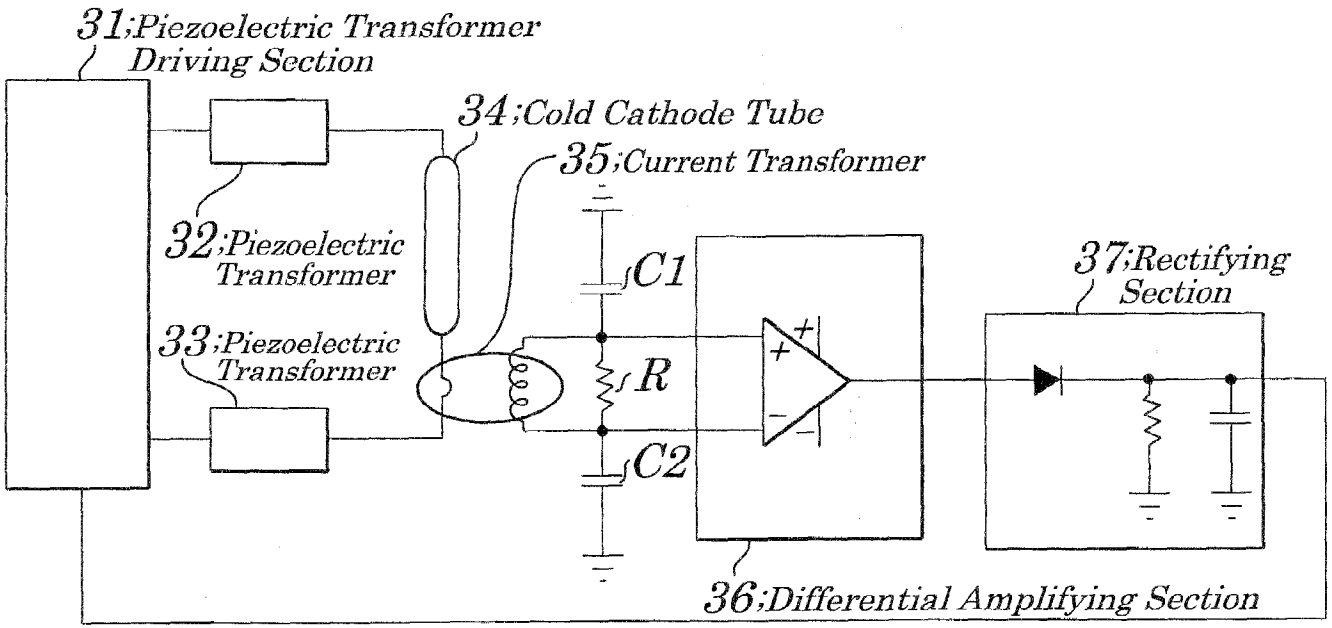
FIG. 13 (PRIOR ART)
FIG. 13 is a block diagram showing electrical configurations of a conventional piezoelectric transformer driving circuit disclosed in Patent Reference 2.
Figure 14:
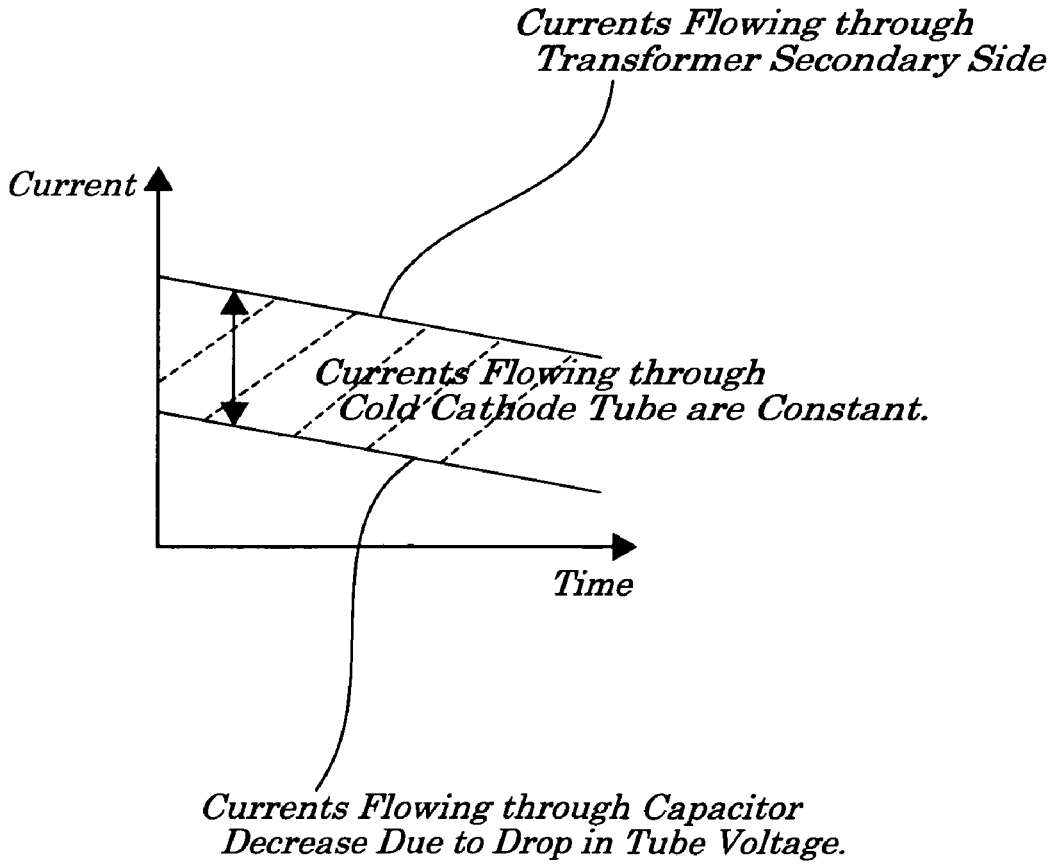
FIG.14 (PRIOR ART)
FIG. 14 is a graphical diagram explaining problems associated with the conventional cold cathode lighting device of FIG. 11.

Furthermore, in the cold cathode tube lighting device described in the above embodiments, one cathode tube 48 is connected, however, a plurality of cold cathode tubes may be connected and, even in that case, almost the same actions and effects obtained in the above embodiments can be achieved. In this case, as shown in FIG. 9, two cold cathode tubes 48 are provided and a driving pulse voltage "e1" is applied to one terminal of each of the two cold cathode tubes 48 through a ballast coil 101 used to stabilize a tube current of each of the cold cathode tubes and a driving pulse voltage "e2" is applied to another terminal of each of the two cold cathode tubes 48 through a ballast coil 102 having the same function as the ballast coil 101. As shown in FIG. 10, a driving pulse voltage "e1" may be applied to one terminal of each of the two cold cathode tubes 48 through a ballast capacitor 103 and a driving voltage "e2" may be applied to another terminal of each of the two cold cathode tubes 48 through a ballast capacitor 104.

What is claimed is:

1. A cold cathode tube lighting device comprising:

a first separately-excited inverter which comprises a first resonant circuit comprising a first transformer and a first resonance capacitor, connected to a first input terminal of a cold cathode tube;

a second separately-excited inverter which comprises a second resonant circuit comprising a second transformer and a second resonance capacitor, connected to a second input terminal of said cold cathode tube;

wherein a first driving pulse voltage is generated by said first resonant circuit in said first separately-excited inverter, and a second driving pulse voltage is generated by said second resonant circuit in said second separately-excited inverter, and wherein the first and the second driving pulse voltages are 180° out of phase with each other, and are applied alternately to said first input terminal and said second input terminal of said cold cathode tube from a transformer secondary side of said first transformer and a transformer secondary side of said second transformer to light said cold cathode tube, the device further comprising:

a tube current controlling unit to detect a tube current flowing through said cold cathode tube, based on a first current flowing through said transformer secondary side of each of said first and said second transformers, and on a second current flowing through each of said first and said second resonance capacitors, and to exert control so that the tube current maintains a predetermined value, based on the detected result.

2. The cold cathode tube lighting device according to claim 1, wherein said tube current controlling unit is so configured as to detect respectively the first current of a low-voltage side at said transformer secondary side of each of said first and said second transformers and the second current flowing through each of said first and said second resonance capacitors, to calculate a difference between the first current and the second current detected respectively in each of said first and second separately-excited inverters, to obtain the tube current based on the difference, and to change a frequency of each of the first and the second driving voltages for setting so that the tube current maintains the predetermined value, based on the obtained result.

3. The cold cathode tube lighting device according to claim 1, wherein said tube current controlling unit is so configured as to detect respectively the first current of a low-voltage side at said transformer secondary side of each of said first and said second transformers and the second current flowing through each of said first and said second resonance capacitors, to calculate a difference between the first current and the second current detected respectively in each of said first and second separately-excited inverters, to obtain the tube current based on the difference, and to change a duty ratio of each of the first and the second driving voltages for setting so that the tube current maintains the predetermined value, based on the obtained result.

4. The cold cathode tube lighting device according to claim 1, further comprising a temperature detecting unit to detect a temperature of said cold cathode tube, wherein said tube current controlling unit detects the tube current flowing through said cold cathode tube based on the detected first current flowing through said transformer secondary side of each of said first and said second transformers, on the detected second current flowing through each of said first and said second resonance capacitors, and on the detected temperature of said cold cathode tube detected by said temperature detecting unit, and exerts control so that said tube current maintains a predetermined value, based on the detected result.

5. The cold cathode tube lighting device according to claim 4, wherein said tube current controlling unit is so configured as to detect respectively the first current of a low-voltage side at said transformer secondary side of each of said first and said second transformers and the second current flowing through each of said first and said second resonance capacitors, to calculate a difference between the first current and the second current detected respectively in each of said first and second separately-excited inverters, to obtain the tube current based on the difference and on a temperature of said cold cathode tube detected by said temperature detecting unit, and to change a frequency of each of the first and the second driving voltages for setting so that the tube current maintains the predetermined value, based on the obtained result.

6. The cold cathode tube lighting device according to claim 4, wherein said tube current controlling unit is so configured as to detect respectively the first current of a low-voltage side at said transformer secondary side of each of said first and said second transformers and the second current flowing through each of said first and said second resonance capacitors, to calculate a difference between the first current and the second current detected respectively in each of said first and second separately-excited inverters, to obtain the tube current based on the difference and on a temperature of said cold cathode tube detected by said temperature detecting unit, and to change a duty ratio of each of the first and the second driving voltages for setting so that the tube current maintains the predetermined value, based on the obtained result.

7. An integrated circuit used as the temperature detecting unit and the tube current controlling unit in the cold cathode tube lighting device according to claim 4.

8. The cold cathode tube lighting device according to claim 1, further comprising an output voltage monitoring unit to detect an output voltage of said transformer secondary side of each of said first and said second transformers, and to stop operations of said first and said second separately-excited inverters when an abnormality has occurred in at least one output voltage.

9. An integrated circuit used as the output voltage monitoring unit and the tube current controlling unit in the cold cathode tube lighting device according to claim 8.

10. An integrated circuit used as the tube current controlling unit in the cold cathode tube lighting device according to claim 1.

11. A driving method to be used in a cold cathode tube lighting device comprising: a first separately-excited inverter which comprises a first resonant circuit comprising a first transformer and a first resonance capacitor, connected to a first input terminal of a cold cathode tube; a second separately-excited inverter which comprises a second resonant circuit comprising a second transformer and a second resonance capacitor, connected to a second input terminal of said cold cathode tube; wherein a first driving pulse voltage is generated by said first resonant circuit in said first separately-excited inverter, and a second driving pulse voltage is generated by said second resonant circuit in said second separately-excited inverter, and wherein the first and the second driving pulse voltages are 180° out of phase with each other, and are applied alternately to said first input terminal and said second input terminal of said cold cathode tube from a transformer secondary side of said first transformer and a transformer secondary side of said second transformer to light said cold cathode tube, the method comprising:

detecting a tube current flowing through said cold cathode tube, based on a first current flowing through said transformer secondary side of each of said first and said second transformers, and on a second current flowing through each of said first and said second resonance capacitors, and exerting control so that the tube current maintains a predetermined value, based on the detected result.

12. The driving method according to claim 11, wherein the detecting of the tube current comprises detecting respectively the first current of a low-voltage side at said transformer secondary side of each of said first and said second transformers and the second current flowing through each of said first and said second resonance capacitors, calculating a difference between the first current and the second current detected respectively in each of said first and second separately-excited inverters, and obtaining the tube current based on the difference, and wherein the control is exerted by changing a frequency of each of the first and the second driving voltages for setting so that the tube current maintains the predetermined value, based on the obtained result.

13. The driving method according to claim 11, wherein the detecting of the tube current comprises detecting respectively the first current of a low-voltage side at said transformer secondary side of each of said first and said second transformers and the second current flowing through each of said first and said second resonance capacitors, calculating a difference between the first current and the second current detected respectively in each of said first and second separately-excited inverters, and obtaining the tube current based on the difference, and wherein the control is exerted by changing a duty ratio of each of the first and the second driving voltages for setting so that the tube current maintains the predetermined value, based on the obtained result.

14. The driving method according to claim 11, wherein the detecting of the tube current comprises detecting respectively a temperature of said cold cathode tube, the first current of a low-voltage side at said transformer secondary side of each of said first and said second transformers and the second current flowing through each of said first and said second resonance capacitors, and detecting the tube current flowing through said cold cathode tube, based on the detected first current, the detected second current, and the detected temperature of said cold cathode tube.

15. The driving method according to claim 11, further comprising:

detecting an output voltage of said transformer secondary side of each of said first and said second transformers, and stopping operations of said first and said second separately-excited inverters when an abnormality has occurred in at least one output voltage.

16. A cold cathode tube lighting device comprising:

a first separately-excited inverter which comprises a first resonant circuit comprising a first transformer and a first resonance capacitor, connected to a first input terminal of a cold cathode tube;

a second separately-excited inverter which comprises a second resonant circuit comprising a second transformer and a second resonance capacitor, connected to a second input terminal of said cold cathode tube;

wherein a first driving pulse voltage is generated by said first resonant circuit in said first separately-excited inverter, and a second driving pulse voltage is generated by said second resonant circuit in said second separately-excited inverter, and wherein the first and the second driving pulse voltages are 180° out of phase with each other, and are applied alternately to said first input terminal and said second input terminal of said cold cathode tube from a transformer secondary side of said first transformer and a transformer secondary side of said second transformer to light said cold cathode tube, the device further comprising:

a tube current controlling unit to detect a tube current flowing through said cold cathode tube, based on a first current flowing through said transformer secondary side of said first transformer or said second transformer, and on a second current flowing through said first resonance capacitor or said second resonance capacitor, and to exert control so that the tube current maintains a predetermined value, based on the detected result.

17. The cold cathode tube lighting device according to claim 16, wherein said tube current controlling unit is so configured as to detect respectively the first current of a low-voltage side at said transformer secondary side of said first transformer or said second transformer and the second current flowing through said first resonance capacitor or said second resonance capacitor, to calculate a difference between the detected first current and the detected second current, to obtain the tube current based on the difference, and to change a frequency of each of the first and the second driving voltages for setting so that the tube current maintains the predetermined value, based on the obtained result.

18. The cold cathode tube lighting device according to claim 16, wherein said tube current controlling unit is so configured as to detect respectively the first current of a low-voltage side at said transformer secondary side of said first transformer or said second transformer and the second current flowing through said first resonance capacitor or said second resonance capacitor, to calculate a difference between the detected first current and the detected second current, to obtain the tube current based on the difference, and to change a duty ratio of each of the first and the second driving voltages for setting so that the tube current maintains the predetermined value, based on the obtained result.

19. The cold cathode tube lighting device according to claim 16, further comprising a temperature detecting unit to detect a temperature of said cold cathode tube, wherein said tube current controlling unit detects the tube current flowing through said cold cathode tube based on the detected first current flowing through said transformer secondary side of said first transformer or said second transformer, on the detected second current flowing through said first resonance capacitor or said second resonance capacitor, and on the detected temperature of said cold cathode tube detected by said temperature detecting unit, and exerts control so that said tube current maintains a predetermined value, based on the detected result.

20. The cold cathode tube lighting device according to claim 16, wherein said tube current controlling unit is so configured as to detect respectively the first current of a low-voltage side at said transformer secondary side of said first transformer or said second transformer and the second current flowing through said first resonance capacitor or said second resonance capacitor, to calculate a difference between the detected first current and the detected second current, to obtain the tube current based on the difference and on a temperature of said cold cathode tube detected by said temperature detecting unit, and to change a frequency of each of the first and the second driving voltages for setting so that the tube current maintains the predetermined value, based on the obtained result.

21. The cold cathode tube lighting device according to claim 16, wherein said tube current controlling unit is so configured as to detect respectively the first current of a low-voltage side at said transformer secondary side said first transformer or said second transformer and the second current flowing through said first resonance capacitor or said second resonance capacitor, to calculate a difference between the detected first current and the detected second current, to obtain the tube current based on the difference and on a temperature of said cold cathode tube detected by said temperature detecting unit, and to change a duty ratio of each of the first and the second driving voltages for setting so that the tube current maintains the predetermined value, based on the obtained result.

* * * * *